US008813313B2

(12) United States Patent
Freitas Marinho et al.

(10) Patent No.: US 8,813,313 B2
(45) Date of Patent: Aug. 26, 2014

(54) SPRING-BIASED FLOOR-MOUNTED DOOR HINGE

(71) Applicants: Francisco Alan Freitas Marinho, Fortaleza (BR); Raimundo Raumiro Maia Da Silva, Fortaleza (BR); Maria Do Socorro Gomes de Araujo, Fortaleza (BR)

(72) Inventors: Francisco Alan Freitas Marinho, Fortaleza (BR); Raimundo Raumiro Maia Da Silva, Fortaleza (BR); Maria Do Socorro Gomes de Araujo, Fortaleza (BR)

( * ) Notice: Subject to any disclaimer, the term of this patent is extended or adjusted under 35 U.S.C. 154(b) by 0 days.

(21) Appl. No.: 14/075,955

(22) Filed: Nov. 8, 2013

(65) Prior Publication Data

US 2014/0059804 A1 Mar. 6, 2014

Related U.S. Application Data

(63) Continuation-in-part of application No. PCT/BR2012/000506, filed on Nov. 14, 2012.

(30) Foreign Application Priority Data

Apr. 2, 2012 (BR) ..... 202012007468

(51) Int. Cl.
*E05D 7/08* (2006.01)

(52) U.S. Cl.
USPC ..... 16/378; 16/55; 16/74; 49/388

(58) Field of Classification Search
CPC ..... E05D 7/08; E05D 5/0246; E05F 3/104; E05F 3/20; E05F 1/063; E05Y 2900/132
USPC ..... 16/378, 379, 252, 303, 330, 55, 50, 71, 16/74, 312, 229, 284; 49/236, 239, 388, 49/398
See application file for complete search history.

(56) References Cited

U.S. PATENT DOCUMENTS

| | | | | | |
|---|---|---|---|---|---|
| 665,603 | A | * | 1/1901 | Henry | 16/55 |
| 1,178,460 | A | * | 4/1916 | Smith | 16/55 |
| 1,423,784 | A | * | 7/1922 | Vuille | 16/55 |
| 2,530,331 | A | | 11/1950 | Hubbs | |
| 2,603,818 | A | * | 7/1952 | Carlson | 16/55 |

(Continued)

FOREIGN PATENT DOCUMENTS

| | | |
|---|---|---|
| BR | 0301205 | 12/2004 |
| BR | MU8401309 | 1/2006 |
| EP | 2505755 | 10/2012 |
| GB | 2342120 | 4/2000 |

OTHER PUBLICATIONS

International Bureau, Notification of Receipt of Record Copy for Application No. PCT/BR2012/000506, Mail Date Jan. 23, 2013.

(Continued)

*Primary Examiner* — William Miller
(74) *Attorney, Agent, or Firm* — SoCal IP Law Group LLP; Guy Cumberbatch

(57) ABSTRACT

A constructive arrangement in elastomeric spring for closing doors which comprises a hollow tube having one end provided with a base and the inner area the provision of an elastomeric spring disposed juxtaposed to said base having a tracking member positioned on the elastomeric spring which receives the tracking member on the opposite face whose free end presents edge provided with female fitting which allows the positioning of a cam with male fitting pressed by a pin fixed to the tube through a bushing and having inner cap with fixing holes and protective cap.

12 Claims, 8 Drawing Sheets

(56) References Cited

U.S. PATENT DOCUMENTS

| | | | | | |
|---|---|---|---|---|---|
| 3,378,881 | A | * | 4/1968 | Hentzi et al. | 16/312 |
| 3,398,487 | A | * | 8/1968 | Matyas | 49/239 |
| 3,401,422 | A | * | 9/1968 | Ventura | 16/54 |
| 3,546,736 | A | * | 12/1970 | Booth | 16/312 |
| 3,628,845 | A | * | 12/1971 | Grimm | 312/309 |
| 3,932,913 | A | | 1/1976 | Johnson | |
| 4,697,302 | A | * | 10/1987 | Yuenian | 16/52 |
| 4,785,499 | A | | 11/1988 | Giuffrida et al. | |
| 5,265,311 | A | * | 11/1993 | Gard | 16/312 |
| 6,928,699 | B2 | * | 8/2005 | Sawa | 16/312 |
| 6,990,772 | B2 | * | 1/2006 | Eckel et al. | 49/236 |
| 7,007,341 | B2 | * | 3/2006 | Wang | 16/60 |
| 7,155,776 | B2 | * | 1/2007 | Park | 16/50 |
| 8,166,612 | B2 | * | 5/2012 | Bertolini et al. | 16/244 |
| 8,191,206 | B1 | * | 6/2012 | Bacchetti | 16/378 |
| 8,341,805 | B2 | * | 1/2013 | Duan et al. | 16/303 |
| 8,443,487 | B2 | * | 5/2013 | Bacchetti | 16/51 |
| 8,578,557 | B2 | * | 11/2013 | Yu | 16/55 |
| 2006/0123598 | A1 | * | 6/2006 | Park | 16/378 |
| 2007/0169416 | A1 | * | 7/2007 | Falato et al. | 49/397 |

OTHER PUBLICATIONS

International Searching Authority, Notification of Receipt of Search Copy for Application No. PCT/BR2012/000506, Mail Date Dec. 20, 2012.

Brazil National Institute of Industrial Property, International Search Report for Application No. PCT/BR2012/000506, Mail Date Jan. 21, 2013.

Brazil National Institute of Industrial Property , Notification of Transmittal of the International Search Report and The Written Opinion of the International Searching Authority, of the Declaration for Application No. PCT/BR2012/000506, Mail Date Jan. 31, 2013.

Brazil National Institute of Industrial Property, Written Opinion of the International Searching Authority for Application No. PCT/BR2012/000506, Mail Date Jan. 31, 2013.

* cited by examiner

SPRING-BIASED FLOOR-MOUNTED DOOR HINGE

RELATED APPLICATION INFORMATION

The present application is a continuation-in-part under 35 USC §§120, 363 and 365(*c*) of PCT Application No. PCT/BR2012/000506, filed Nov. 14, 2012, which designates the U.S. and in turn claims priority under 35 U.S.C. §119(*a*) to Brazilian Patent Application No. BR 20 2012 0074686 filed Apr. 2, 2012.

BACKGROUND

This application describes a constructive disposition on elastomeric spring for closing doors. More specifically, the application comprises an elastomeric spring within a hinge mechanism and a rotating pin for engaging a door particularly useful to be installed on the floor.

The conventional hydraulic springs used with doors perform the automatic opening and closing of the door, with minimal effort, to both sides, having on both sides a function of fixed stop, where the door may be parked in a spot approximately 45 degrees.

The floor hydraulic springs of the state of the art are set aligned with the door hardware, and a box is recessed in an area of about 30 centimeters in the floow. In the box is positioned a spring or the pivot in the working position. This size of cut on the floor, besides interfering with the aesthetics of the environment, promotes the ingress of water which is accumulated underneath the box, as well as the hydraulic spring oxidation with damage to the leveling. It is noted that some technical manuals of floor hydraulic springs recommend that paraffin is applied in the inner region of the box to eliminate disturbances in the functioning of the spring, precisely due to ingress of water which affects the operation of the device.

Further, the hydraulic springs of the state of art have a high cost and complex installation, where skill is required by the installer to break the floor and proper installation of the mechanism.

SUMMARY OF THE INVENTION

Thus, one object of this present application is for an elastomeric spring for door closures that replaces the conventional hydraulic springs, providing a mechanical assembly of small size and requires a small hole on the floor for fitting.

One characteristic of the present application is a constructive provision in elastomeric spring for closing doors with reduced dimension, favoring the application indoors without interference on aesthetics.

Another characteristic of the present application is a constructive provision in elastomeric spring for closing doors, which features decrease of manufacturing costs due to a fewer number of components and assembly simplicity of the mechanism.

A further characteristic of the present application is a constructive disposition in elastomeric spring for quickly closing doors and easy installation, taking about four times less time than the hydraulic springs of the state of art, due to being necessary just a small hole in floor for installation, unlike conventional mechanisms in which it is necessary to take a cutout of about 30 centimeters.

A still further characteristic of the present application is a constructive provision in elastomeric spring for closing underweight doors, with reduction in about five times the weight of conventional mechanisms of hydraulic spring.

DESCRIPTION OF THE DRAWINGS

In order to better describe the technical characteristics of constructive disposition on elastomeric spring for closing doors, the figures presented below are listed.

DETAILED DESCRIPTION

The present application provides an improved floor-mounted elastomeric spring hinge for doors which features a number of advantages over previous hydraulic springs. First of all, the spring hinge is relatively compact which lends itself to smaller recesses in the floor. Furthermore, the spring hinge is contained within a closed tubular housing which also helps prevent water ingress. Finally, the spring itself is a relatively durable and elastomeric which is corrosion resistant and predictable in its performance.

Figure 1:
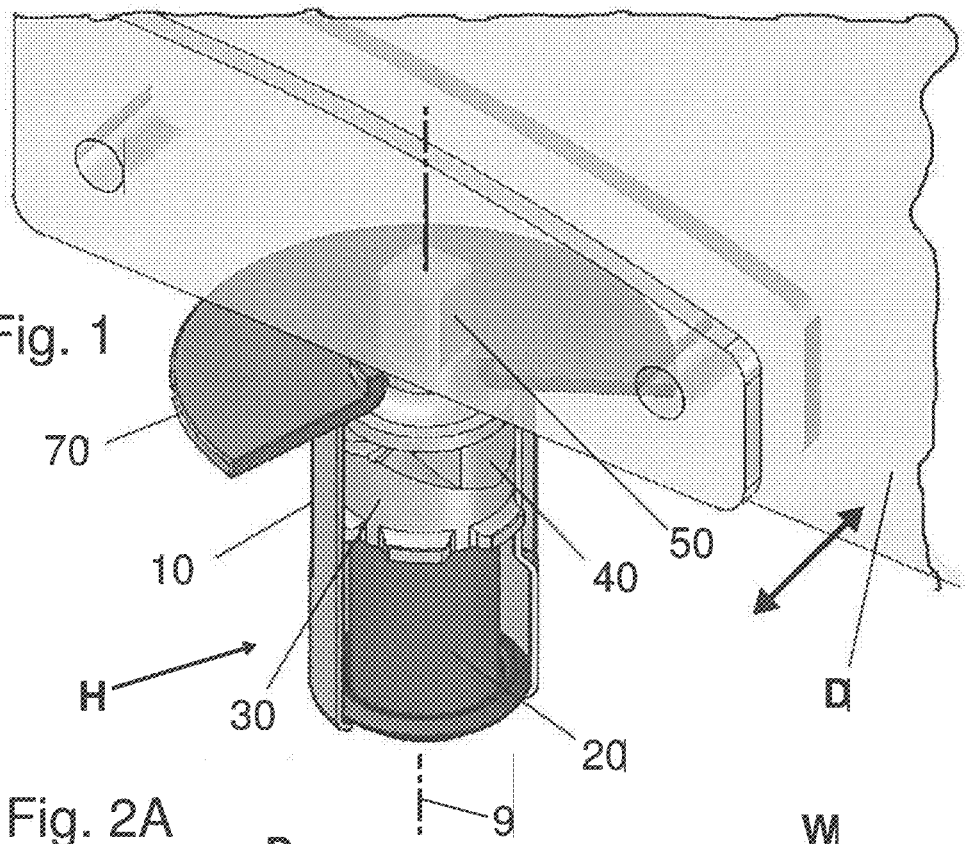
FIG. 1 assembled view is a partially cut-away perspective of an exemplary floor-mounted elastomeric spring hinge for doors.

FIG. 1 is a partially cut-away perspective of an exemplary floor-mounted elastomeric spring hinge H mounted underneath one end of a door D. The door D can swing in either direction is indicated by the movement arrow, pivoting about an axis 9 corresponding with a central axis of the spring hinge H. In this regard, the outer components of the spring hinge H include a lower hollow tube 10 having a series of vertical splines 12 (see FIG. 3) formed in an upper portion of its wall. The hollow tube 10 mounts in a pre-formed cavity in the floor (not shown) and is capped by an upper disc-shaped finish cover 70 over which the door D rotates. An upstanding post or pin 50 of the spring hinge H project into a similarly-sized and shaped cavity (not shown) in the bottom edge of the door D. A pivot in line with the pin 50 is all that is required at the top edge of the door, though a second spring hinge H may also be used. As will be explained below, movement of the door D in either direction causes the pin 50 to rotate against the force of an elastomeric spring 20 house within the hollow tube 10, thus providing a return force to close the door.

Figure 2A:
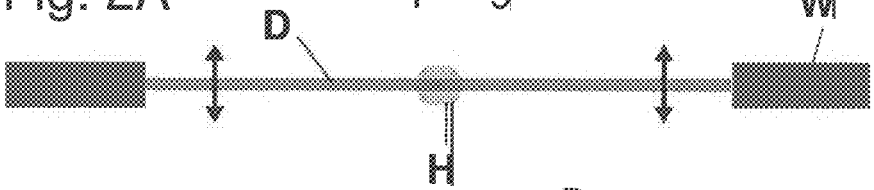
FIGS. 2A and 2B are schematic views looking down on two different door configurations utilizing the elastomeric spring hinge shown in FIG. 1.
Figure 2B:
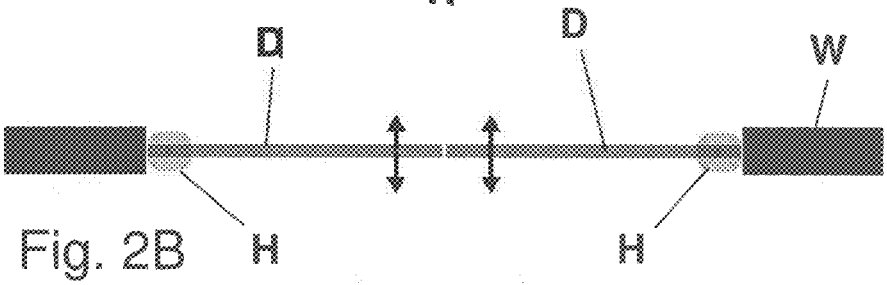

FIG. 2A schematically indicates a single door D between two walls W and mounted for rotation about a spring hinge H which is positioned in the center of the door. The movement arrows indicate that the door D can swing open in either sense of rotation (CW or CCW) by pushing on either side of the central point. FIG. 2B indicates a pair of doors D each mounted for rotation about a spring hinge H of the present application each of which is located at one end of the door, typically adjacent a wall W. The movement arrows indicate that both doors D can rotate in both directions, CW or CCW. Of course, the spring hinge H of the present application can be mounted under a variety of doors, the illustrated configurations thus being exemplary only. Furthermore, it should be understood that the spring hinge H of the present application is particularly well-suited for floor mounting to permit rotation of doors about vertical axes, but could also be mounted in structures that permit rotation of doors or other such closures about horizontal axes, or other angles of rotation not illustrated. Of course, one aspect is the weight of the door causing compression of the spring 20, and so hinges mounted at other orientations must include an analogous component of such force.

Figure 3:
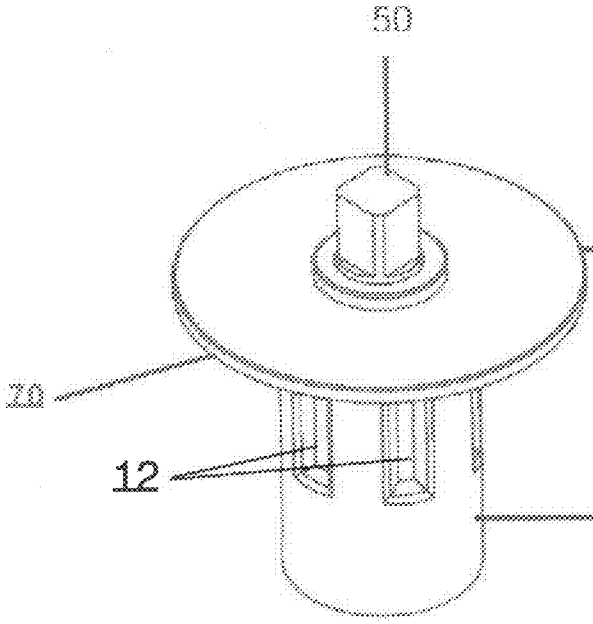
FIG. 3 is a top perspective view of the exterior of the exemplary elastomeric spring hinge.
Figure 4:
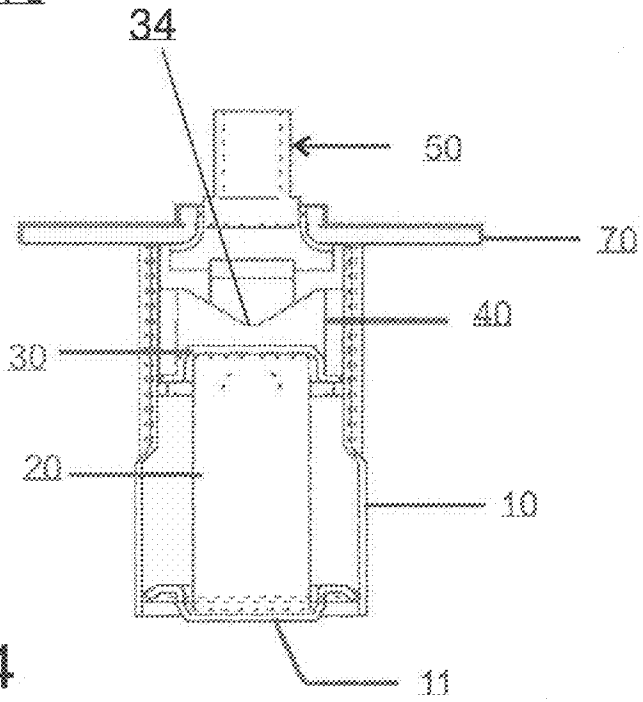
FIG. 4 is a vertical sectional view through the elastomeric spring hinge.

With reference to FIGS. 3, 4 and the exploded views of FIGS. 5A-5D, internal working opponents of the exemplary spring hinge H will be described. As mentioned, the spring hinge H comprises a hollow tube 10 having at a lower closed end a base 11 and defining within an inner volume that contains the elastomeric spring 20. A base of a tracking member 30 having on an upper face a cam follower 31 defines a downwardly-opening cup 32 that receives an upper end of the cylindrical elastomeric spring 20. The tracking member 30 includes a plurality of outwardly-projecting teeth 33 that fit closely within vertical channels defined on the inside of the splines 12 formed in the hollow tube 10. Preferably the splines 12 are stamped or pressed into a metallic tube 10. The tracking member 30 can thus slide vertically within the hollow tube 10 but is restrained by rotation therein by the engagement between the teeth 33 and splines 12.

Figure 8A:
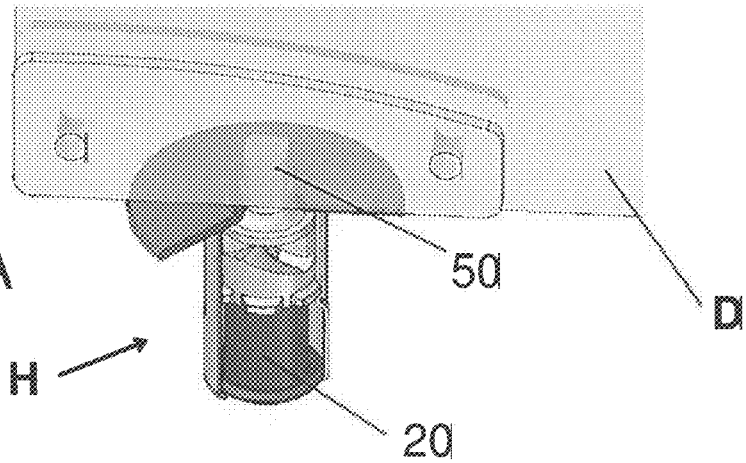
FIGS. 8A-8F are partially cut-away perspective views of the exemplary elastomeric spring hinge mounted at one end of a swinging door and showing movement of the internal components at various positions of the door.
Figure 8B:
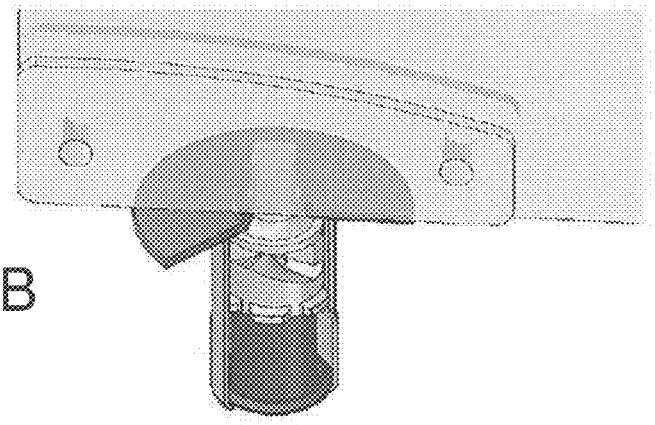
Figure 8C:
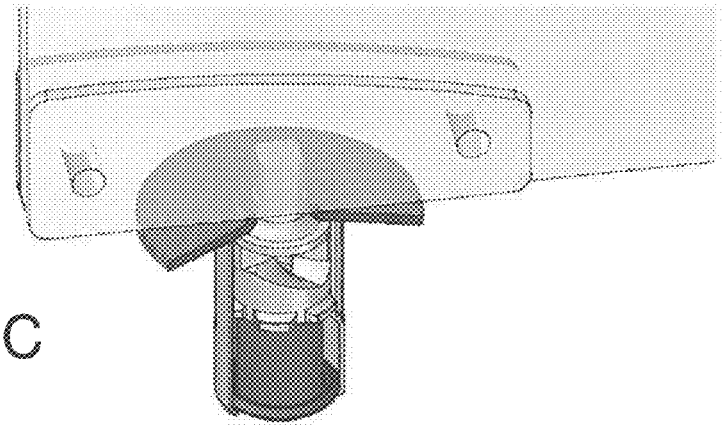
Figure 8D:
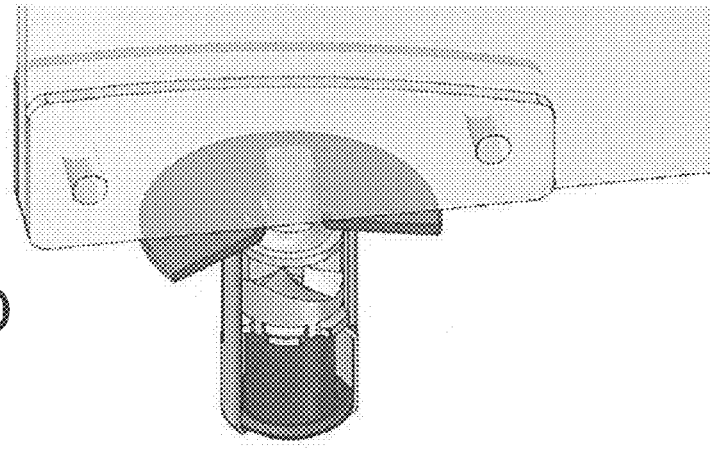
Figure 8E:
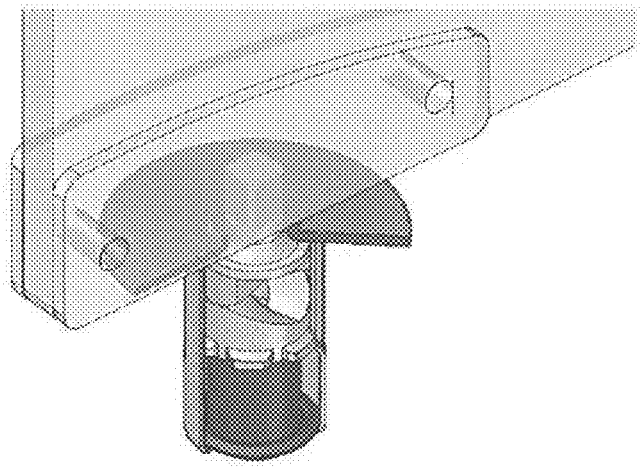
Figure 8F:
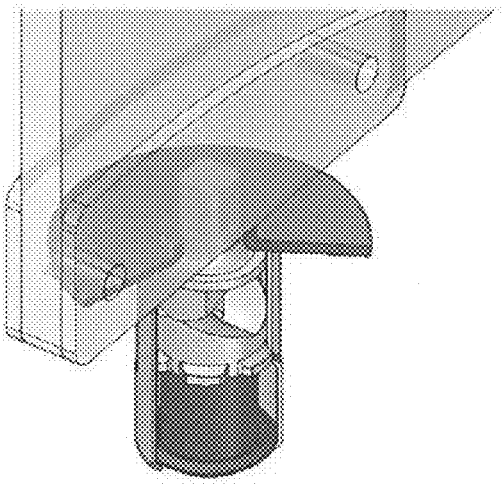

The upper surface of the cam follower 31, best seen from one side in FIG. 4 and in perspective in FIG. 8F, defines a generally V-shaped groove 34 that receives a lower cam surface 41 of a cam 40. The cam 40 has an elongated somewhat rectangular block shape with the cam surface 41 underneath and a relatively flat upper surface (not shown) having features (depressions or rails) which engage a pair of protrusions 51 on the lower surface of a pin 50, whose purpose will become clear below. The lower cam surface 41, best seen in FIG. 5B, includes four gently curved quadrants 42 defined by the apices of V-shaped depressions 43 on both long sides as well as by an aperture 44 at the center of the cam 40 that separates two relatively sharp ridges 45. The ridges 44 form the lowermost extent of each of the four quadrants 42, and each quadrant curves up and away therefrom to the boundaries of the long and short sides of the cam 40. The two ridges 45 extend parallel to the long dimension of the cam 40 with a break in the middle at the aperture 44. The cam surface 41 therefore has a double helix shape on either side of the aperture 44 that cooperates with the cam follower 31 on the tracking member 30, which also has a double helix shape that is essentially the mirror image of the cam surface. The assembly is in a resting position with the elastomeric spring 20 either uncompressed or only slightly compressed when the two ridges 45 are positioned in the V-shaped groove 34 of the cam follower 31, as seen in FIGS. 1 and 4.

As mentioned, the lower end of the pin 50 comprises the protrusions 51 for coupling with the cam 40. Rotation of the pin 50 thus rotates the cam 40, which in turn causes the lower cam surface 41 to act on the cam follower 31. Rotation away from the resting position of FIGS. 1 and 4 thus causes two of the four curved surfaces of the quadrants 42 to begin pushing down on the cam follower 31. Downward movement of the tracking member 30 ensues, which in turn compresses the elastomeric spring 20. The outward teeth 33 of the tracking member 30 fit into the splines 12 of the tube 10, thus preventing rotation of the tracking member. The tracking member 30 thus compresses the elastomeric spring 20 resulting in an equal and opposite upward reaction force from the spring.

In a preferred embodiment the splined tube 10 is welded at its upper end to an annular disk-shaped cap 80, with the finish cover 70 fitted closely over the cap 80. The cap 80 has a central hole which receives an annular bushing 60. The pin 50 includes an upper extension 52 that projects through the bushing 60 and through both the cap 80 and finish cover 70. As seen in FIGS. 1 and 3, the extension 52 projects upward far enough to engage a similarly-shaped female cavity (not shown) in the underside of the edge of the door D. In one embodiment, the extension 52 has a square horizontal cross-sectional profile with chamfered corners, which makes with a similarly-shaped female cavity in the underside of the door, although other non-circular configurations that provide keyed engagement between the extension 52 and cavity in the door are contemplated.

The weight of the door D and upward reaction force transmitted to the tracking member 30 from the elastomeric spring 20 tends to cause engagement of the cam follower 31 and cam surface 41. When the door D is pushed open, the cavity on the lower edge of the door rotates the pin 50 via the extension 52. Because of the engagement between the protrusions 51 on the underside of the pin 50 and the upper surface of the cam 40, rotation of the door D also causes rotation of the cam. This then forces the tracking member 30 downward against the compressive force of the spring 20. Because the ridges 44 always want to return to the generally V-shaped groove 34 in the cam follower 31, the spring 20 naturally resists opening up the door and provides a return torque toward the door closed position.

Figures 5A, 5B:
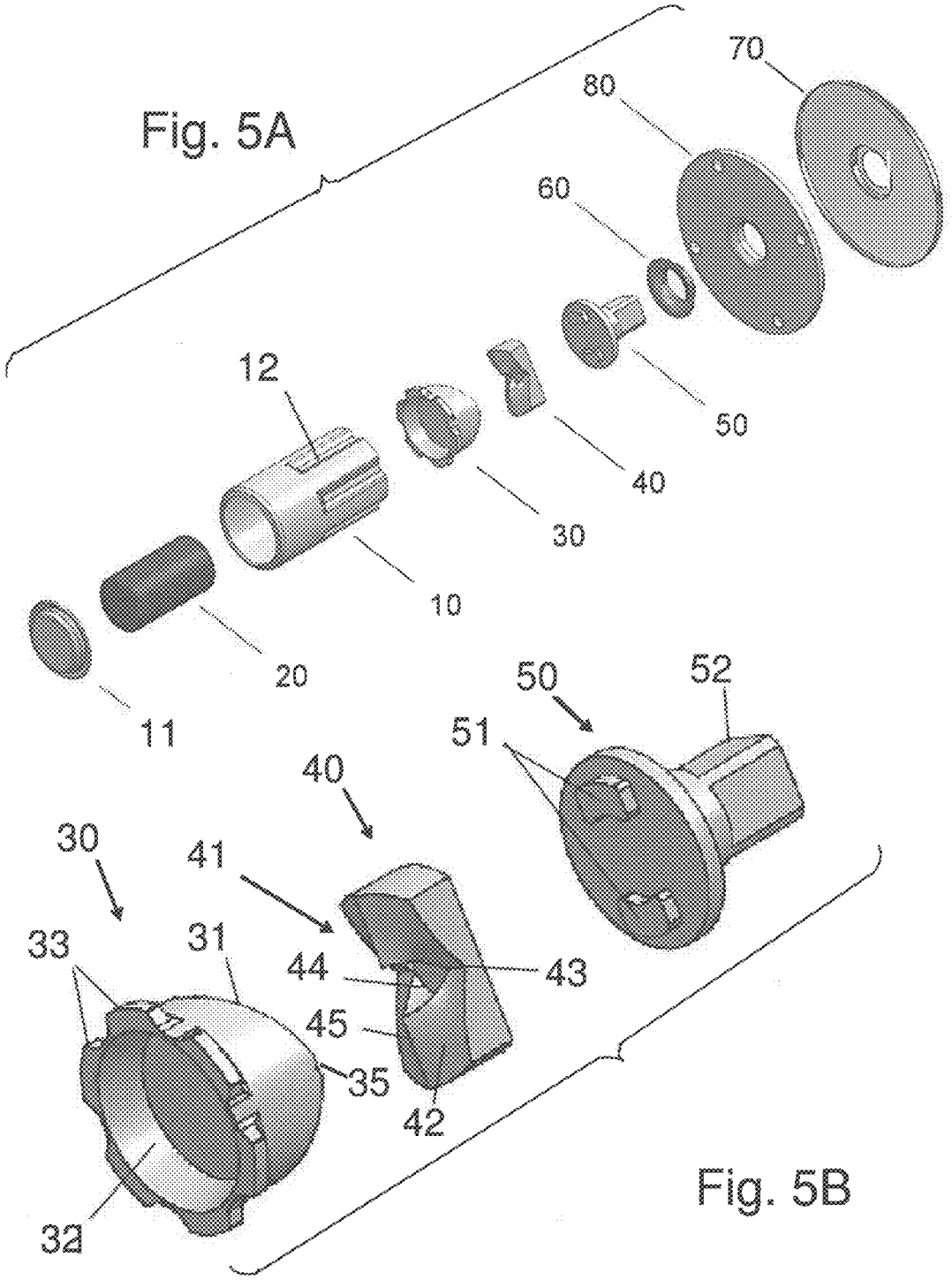
FIGS. 5A-5D are perspective exploded views of components of the elastomeric spring hinge.
Figures 5C, 5D:
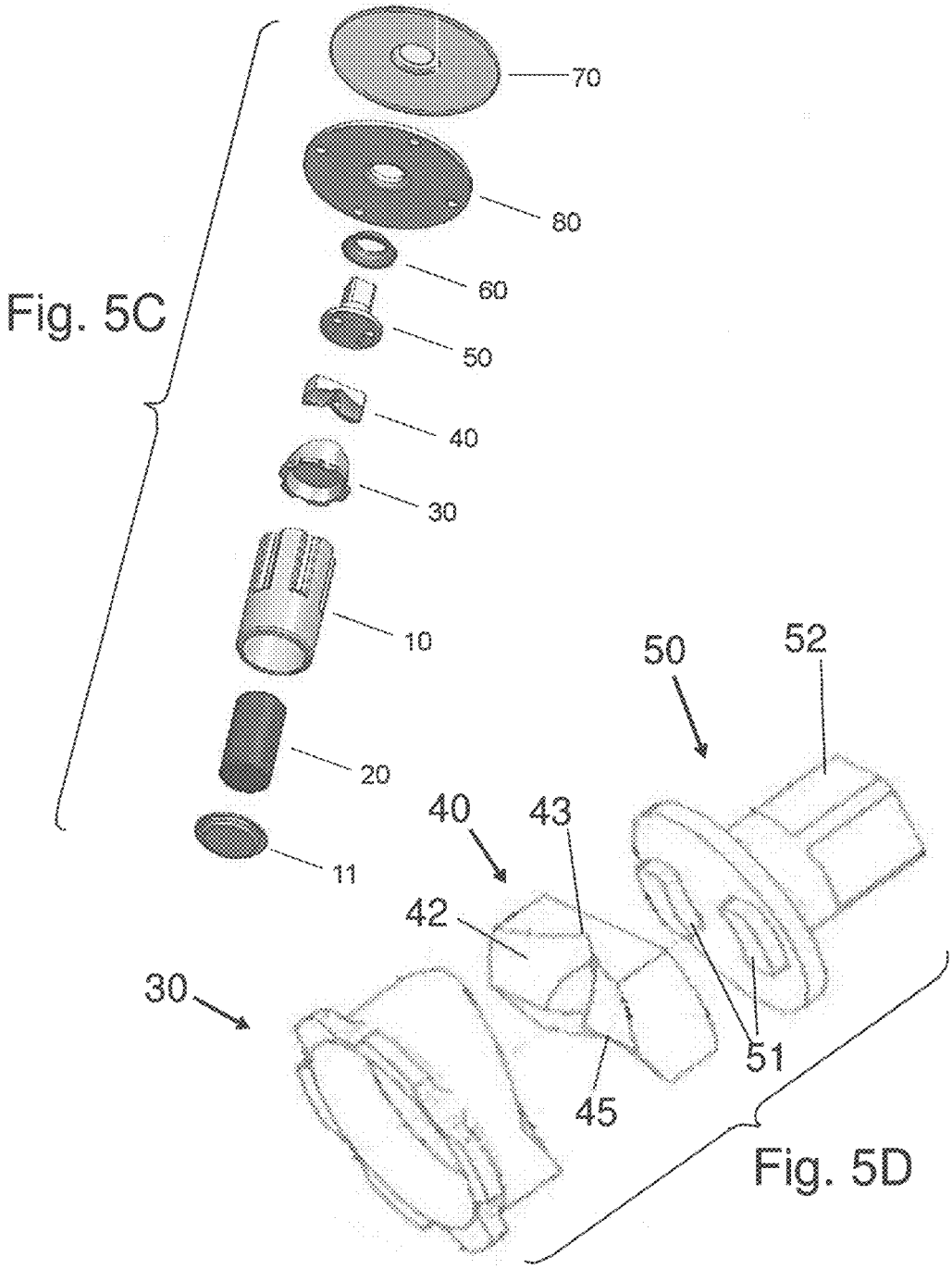

In addition, in a preferred embodiment, a neutral, door open position is provided by the spring hinge H. For example, the cam follower 31 of the tracking member 30 desirably includes a flat or slightly concave apex 35 at the top of both of the upwardly rising sides, as seen in FIG. 5B. These apices 35 are located 90° from the lowest point of the V-shaped groove 34. When the ridges 44 of the cam surface 41 reached the apices 35, and the door is not pushed any farther, the ridges tend to remain temporarily at the apices. This is not a highly stable position, but allows a user to temporarily pause the door in its open position, perhaps within a range of about 10°. A slight push on the door causes the ridges 44 to move past the apices 35, permitting the elastomeric spring 20 to push the tracking member 30 upward, thus rotating the door to its closed position.

A preferred embodiment of elastomeric spring 20 comprises a cylindrical mass made of an elastomer, such as rubber. Alternatively, the spring 20 may be is made of standard spring steel. In either case, the spring 20 has a spring constant calibrated to be sufficient to bias the corresponding door to the closed position when not in the neutral, door open position. The spring may also help maintain the door in the a neutral, door open position. The spring rate essentially depends on the weight of the door, and thus can vary.

The two camming parts, tracking member 30 and cam 40, are desirably made of sintered steel produced by powder metallurgy, molding, powder forging, gel condensation, or other similar processes. On specific material used has the following characteristics and formation parameters, though these numbers are merely exemplary:

Chemical composition (ranges): Nickel: 1.9 . . . 3.0%, Copper: 1.0 . . . 3.0%, Moly: 0.5 . . . 0.9%, Carbon: 0.6 . . . 1.0%;

Density: 6.95 g/cc minimum;

Sintering @1120 C/25 minimum;

Direct Cooling: 2.5 C/sec minimum;

Apparent Hardness: 36 HRC minimum after the tempering;

Particle Hardness: 650 HV0.1 minimum after the tempering;

Tensile Strength: 750 MPa minimum;

Yield Strength: 650 MPa minimum;

Impact Energy: 15 J minimum;

Fatigue strength: 230 MPa minimum.

Figure 6A:
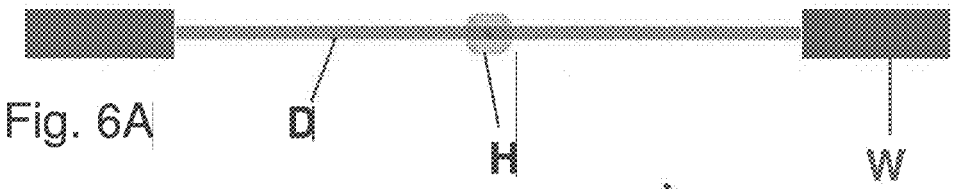
FIGS. 6A-6C are schematic views looking down on a single swinging door having an elastomeric spring hinge of the present application mounted along a central vertical axis and showing various positions of the door.
Figure 6B:
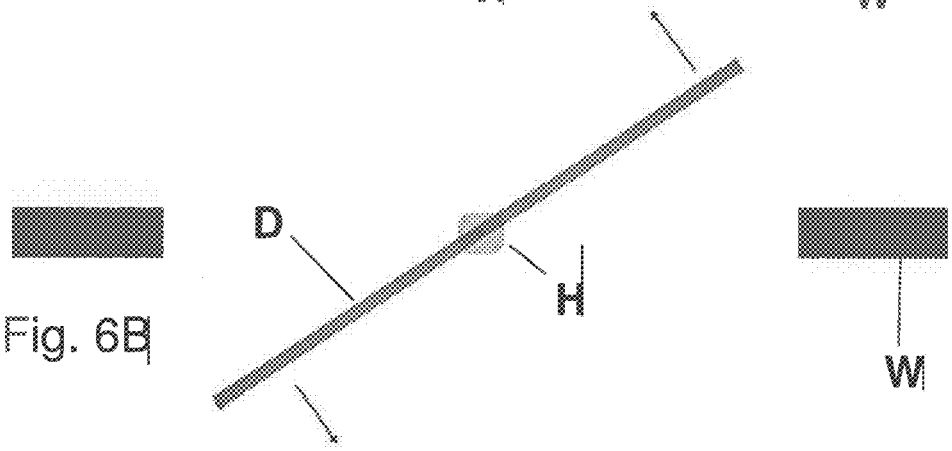
Figure 6C:
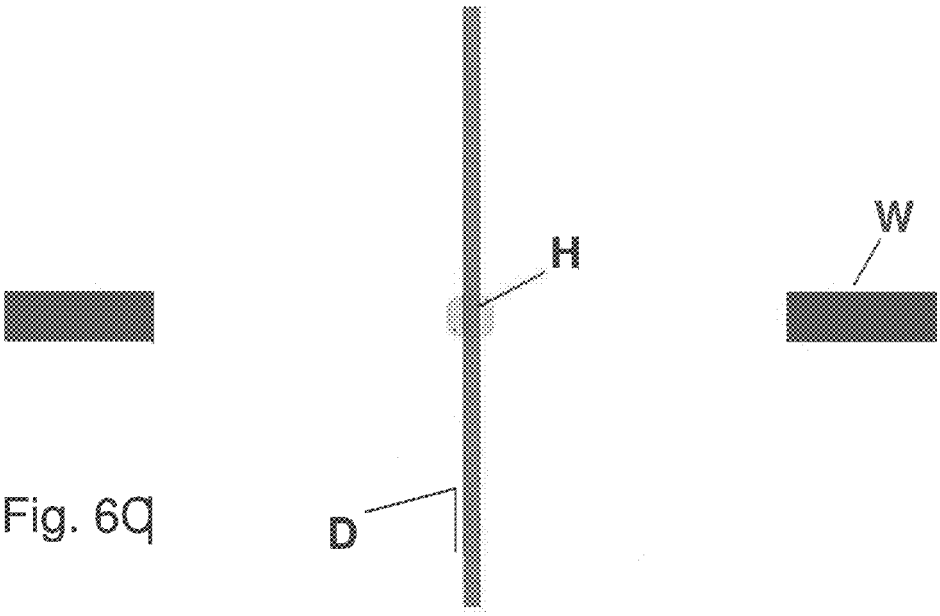

FIGS. 6A-6C are schematic views looking down on a single swinging door D having an elastomeric spring hinge H mounted along a central vertical axis. The door D rotates within a frame formed by two walls W. FIG. 6B shows the door D swinging in a CCW rotation to an angle of about 30°. If the person passing through the door D lets go at this point, the door will swing back to the closed position as seen in FIG. 6A. FIG. 6B illustrates the door D pushed open to a 90° position, at which point it will be somewhat stable, as explained above. Simply rotating the door D in one direction or another will move the door from its temporary stable position, allowing it to close again.

Figure 7A:
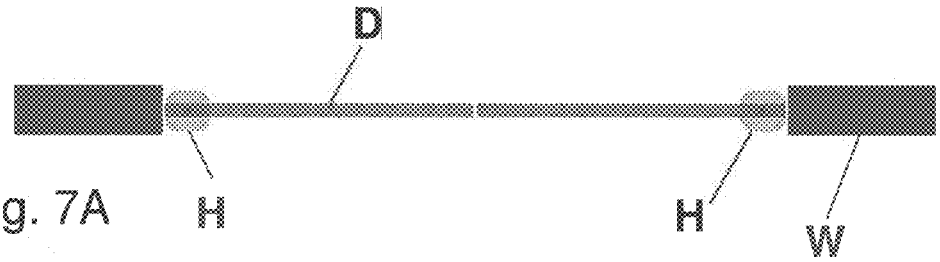
FIGS. 7A-7C are schematic views looking down on double swinging doors each having an elastomeric spring hinge of the present application mounted along a vertical axis at one end and showing various positions of the door.
Figure 7B:
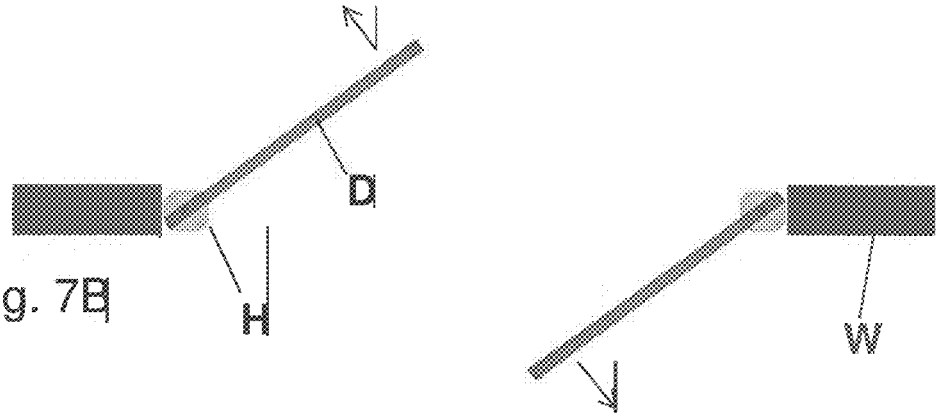
Figure 7C:
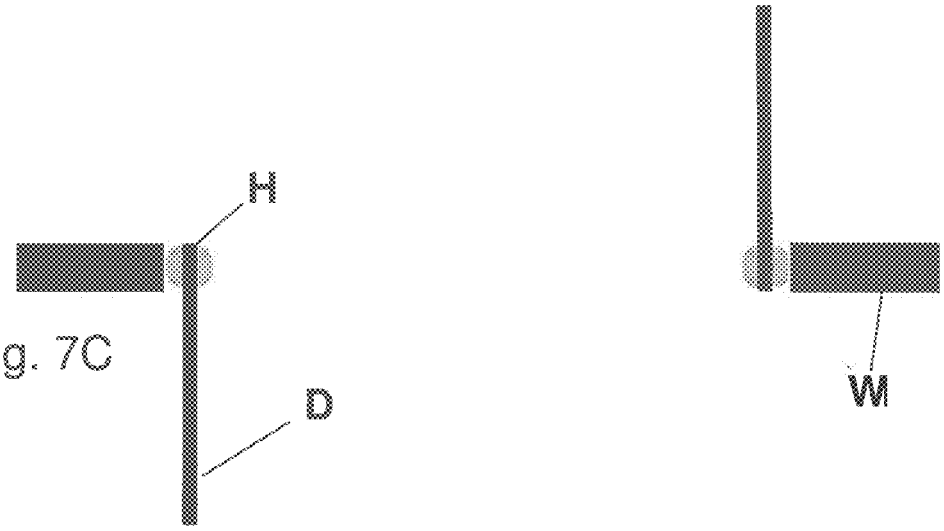

FIGS. 7A-7C show a set of double swinging doors D each having an elastomeric spring hinge H mounted along a vertical axis at one end. FIG. 7A shows the doors in their closed positions, while FIG. 7B shows both doors being swung open in CCW directions. Finally, FIG. 7C shows both doors at 90° in their temporarily stable positions.

FIGS. 1 and 8A-8F are partially cut-away perspective views of the spring hinge H mounted at one end of a swinging door D to show movement of the internal components at various positions of the door. In operation, the door D mounted on the pin 50 is held closed by the force of the elastomeric spring 20, as shown in FIG. 1. FIG. 8A shows a slight rotation of the door D in the CCW direction such that the pin 50 rotates the cam 40 which pushes down the tracking member 30 against the elastomeric spring 20. FIGS. 8B-8F show the door rotated progressively farther such that the cam surface 41 acts on the cam follower 31 forcing down the tracking member 30 against the spring 20. FIG. 8F shows the mechanism in a position which is approximately 90° from the resting position, which as mentioned above may be temporarily stable.

When the door is released before 90°, the force of the elastomeric spring 20 pushes up the tracking member 30, which, alongside the double helix, rotates the cam 40 and the pin 50, closing the door until it reaches the generally V-shaped groove 34 of the double helix of the cam follower 31, where the force of the elastomeric spring keeps it closed.

For installation, a worker makes a mark on the floor so that the central axis of the pin 50 is positioned in alignment with the door hardware. With the use of a drill and a hole saw bit, a hole 7 centimeters depth and 3 centimeters diameter is made, and then the tube 10 of the hinge H positioned inside the hole. Once the tube 10 is fitted into the hole, it is secured in place with screws, thus fixing the pin 50 protecting upward from the floor. After fixing on the floor, a trim piece is placed under pressure. Then, a glass or wood door is installed. This assembly is much smaller than prior hinges, and the assembly is much easier and does not require the introduction of paraffin or the like to prevent ingress of water Closing Comments Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to methods, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of," respectively, are closed or semi-closed transitional phrases with respect to claims. Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A spring biased floor-mounted door hinge, comprising:

a generally tubular housing having a splined peripheral wall;

an elastomeric spring positioned within the tubular housing;

a tracking member in contact with an upper end of the elastomeric spring and having outwardly projecting teeth that engage the splined peripheral wall of the housing to prevent relative rotation therebetween, the tracking member having a cam follower on an upper surface;

a cam having a lower cam surface that engages the cam follower of the tracking member, the cam further having structural features on an upper surface; and a pin having a lower surface with protrusions that engage the structural features on the upper surface of the cam to prevent relative rotation therebetween, the pin having an upward extension with a non-circular shape that provides a keyed engagement with a similarly-shaped cavity on a lower edge of a door, wherein rotation of the door rotates the pin, which in turn rotates the cam and causes interaction between the lower cam surface in the cam follower of the tracking member, thus forcing the tracking member downward and compressing the elastomeric spring.

2. The door hinge of claim 1, wherein the lower cam surface has a double helix shape and at least one ridge forming a lowermost point which engages a generally V-shaped groove in the cam follower.

3. The door hinge of claim 2, wherein the cam follower has a flat apex approximately 90° rotationally from the V-shaped groove that provides a neutral, open position for the door.

4. The door hinge of claim 1, wherein the tubular housing has a depth of about 7 centimeters.

5. The door hinge of claim 4, wherein the tubular housing has a diameter of about 3 centimeters.

6. The door hinge of claim 1, wherein the elastomeric spring comprises a cylindrical mass made of an elastomer.

7. A spring biased floor-mounted door hinge, comprising:

a generally tubular housing having a peripheral wall;

an elastomeric spring positioned within the tubular housing;

a tracking member within the housing and in contact with an upper end of the elastomeric spring, the tracking member and peripheral wall of the housing having respective cooperating engaging structure to prevent relative rotation therebetween, the tracking member also having a cam follower on an upper surface with a generally V-shaped groove;

a cam having a lower cam surface with a double helix shape and at least one ridge forming a lowermost point which engages the generally V-shaped groove in the cam follower in a closed position of a door, the cam further having structural features on an upper surface; and a pin having a lower surface with protrusions that engage the structural features on the upper surface of the cam to prevent relative rotation therebetween, the pin having an upward extension with a non-circular shape that provides a keyed engagement with a similarly-shaped cavity on a lower edge of the door, wherein rotation of the door rotates the pin, which in turn rotates the cam and causes the at least one ridge of the cam to rotate out of the generally V-shaped groove, thus forcing the tracking member downward and compressing the elastomeric spring.

8. The door hinge of claim 7, wherein the double helix shape defines four curved quadrants that engage similarly shaped but mirror image surfaces on the cam follower.

9. The door hinge of claim 7, wherein the cam follower has a flat apex approximately 90° rotationally from the V-shaped groove that provides a neutral, open position for the door.

10. The door hinge of claim 7, wherein the tubular housing has a depth of about 7 centimeters.

11. The door hinge of claim 10, wherein the tubular housing has a diameter of about 3 centimeters.

12. The door hinge of claim 7, wherein the elastomeric spring comprises a cylindrical mass made of an elastomer.

* * * * *